United States Patent [19]

Hackemesser et al.

[11] Patent Number: 4,908,121

[45] Date of Patent: Mar. 13, 1990

[54] FLEXIBLE FEED PYROLYSIS PROCESS

[75] Inventors: Larry G. Hackemesser; Bradley L. Lankford, both of Houston, Tex.

[73] Assignee: The M. W. Kellogg Company, Houston, Tex.

[21] Appl. No.: 861,963

[22] Filed: May 12, 1986

[51] Int. Cl.[4] ..... C10G 9/20

[52] U.S. Cl. ..... 208/85; 208/130; 208/132; 585/648; 585/650

[58] Field of Search ..... 208/130, 106, 132, 85; 585/648, 649, 650, 903, 910, 914

[56] References Cited

U.S. PATENT DOCUMENTS

| | | | |
|---|---|---|---|
| 2,147,399 | 2/1939 | Borden | 585/648 |
| 2,893,941 | 7/1959 | Kohfeldt et al. | 208/48 |
| 3,291,573 | 12/1966 | Frescoln | 23/284 |
| 3,557,241 | 1/1971 | Kivlen et al. | 585/648 |
| 3,580,959 | 5/1971 | Dorner | 260/683 |
| 3,617,493 | 11/1971 | Wirth et al. | 208/80 |
| 4,012,457 | 3/1977 | Bredeson et al. | 585/648 |
| 4,264,432 | 4/1981 | Gartside | 208/48 R |
| 4,361,478 | 11/1982 | Gengler et al. | 208/130 |
| 4,479,869 | 10/1984 | Petterson et al. | 208/130 |

*Primary Examiner*—Anthony McFarlane

[57] ABSTRACT

When steam cracking hydrocarbons to lower olefins in a tubular fired furnace having a convection section for preheating hydrocarbon feed, feedstock flexibility to process light feeds is provided by cooling mixed feed of steam and hydrocarbon followed by reheating to the desired mixed feed temperature.

9 Claims, 3 Drawing Sheets

861963

FLEXIBLE FEED PYROLYSIS PROCESS

BACKGROUND OF THE INVENTION

This invention relates to steam pyrolysis of hydrocarbons in tubular, fired furnaces to produce cracked gases containing ethylene.

The basic components of steam cracking or steam pyrolysis furnaces have been unchanged for many years. The furnaces comprise a radiant chamber fired by fuel to a high temperature and a cracking coil disposed within the radiant chamber. Cracking coil outlet temperatures are between about 815° C. and 930° C. The furnaces additionally comprise a convection coil section for utilization of waste heat typically in preheating hydrocarbon feed, heating diluent steam, heating the mixed feed of diluent steam and hydrocarbon feed, and utility fluid heating for use in the ethylene unit.

While fundamental elements of these furnaces are the same, specific radiant section designs may vary according to requirements of product mix, feedstock choice, heat efficiency, and cost. Nevertheless, radiant sections can be designed to handle a wide spectrum of feedstocks and product mixes by varying the hydrocarbon to dilution steam ratio and furnace firing. Despite differences in the required radiant heating duty, fluid velocities, and process temperatures, a particular cracking coil may be efficiently employed to produce a constant amount of ethylene from a full range of feedstocks.

Regrettably, this flexibility does not exist in the convection section because of the wide variation in steam and hydrocarbon feed preheat duties that exist for ethane at one end of the feed spectrum to vacuum gas oil at the other end. By way of example, up to five times as much dilution steam may be required for gas oil cracking than for ethane cracking which, therefore, requires more steam preheat duty per unit of feedstock. By way of further example, the yield of ethylene from gas oil feed is substantially lower than that from ethane. For constant ethylene production, therefore, more gas oil must be preheated and, additionally, vaporized. This increased heat duty, again, requires substantially greater hydrocarbon and dilution steam preheat coil surface. Because of variable preheating requirements in the convection section, a cracking furnace designed specifically for heavy feedstocks such as gas oil cannot effectively be used for gas feedstocks and vice versa. To a lesser extent, this inflexibility also exists between naphtha and gas oil feedstocks. The principal problem resulting from use of light feeds in a furnace designed for heavy feeds is feed overheating and cracking in the convection section which occurs from a combination of higher radiant section temperatures necessarily employed on light feeds and excessive coil surface in the convection section. Convection coil cracking results in fouling of the convection coils as well as longer cracking residence times and disruption of desired cracking tube temperature profiles with attendant product degradation.

It is therefore an object of this invention to provide a steam cracking process having flexibility to process a range of feedstocks without significant sacrifice of furnace production capacity or operability.

SUMMARY OF THE INVENTION

According to the invention, a process is provided for steam cracking hydrocarbon feed in a tubular, fired furnace having a convection section for preheating the hydrocarbons and a radiant section for cracking the preheated hydrocarbons wherein, in order to provide feedstock flexibility without overheating the feed prior to its introduction to the cracking tubes, the mixed feed resulting from combination of preheated initial hydrocarbon feed and process dilution steam is cooled and then reheated in the convection section of the furnace.

DESCRIPTION OF THE PREFERRED EMBODIMENTS

The extent of mixed feed cooling is principally a function of the feed itself. In a particular furnace having heavy gas oil cracking capability, an ethane mixed feed must be cooled more than, for example, a naphtha feed. Correspondingly, a light gas oil feed will require less cooling. Where the initial hydrocarbon feed is normally gaseous, the mixed feed will typically be cooled by from 55° C. to 220° C. and then reheated to a temperature in the range between 565° C. and 705° C. just prior to introduction of the mixed feed to the cracking tubes. Where the initial hydrocarbon feed is a normally liquid hydrocarbon having an initial boiling point between 25° C. and 120° C. and an end point between 150° C. and 230° C., the mixed feed will typically be cooled by from 55° C. to 140° C. and then reheated to a temperature in the range between 540° C. and 650° C.

Since feedstock flexibility is desired with full utilization of both radiant and convective heat in the furnace, it follows that hydrocarbon vaporized but not subsequently cracked represents a thermal loss. Therefore, separation of preheated initial hydrocarbon feed with rejection of heavier material is not desired. That is to say, all of the initial feed that is preheated in the convection section of the furnace is introduced to the cracking tubes.

Figure 1:
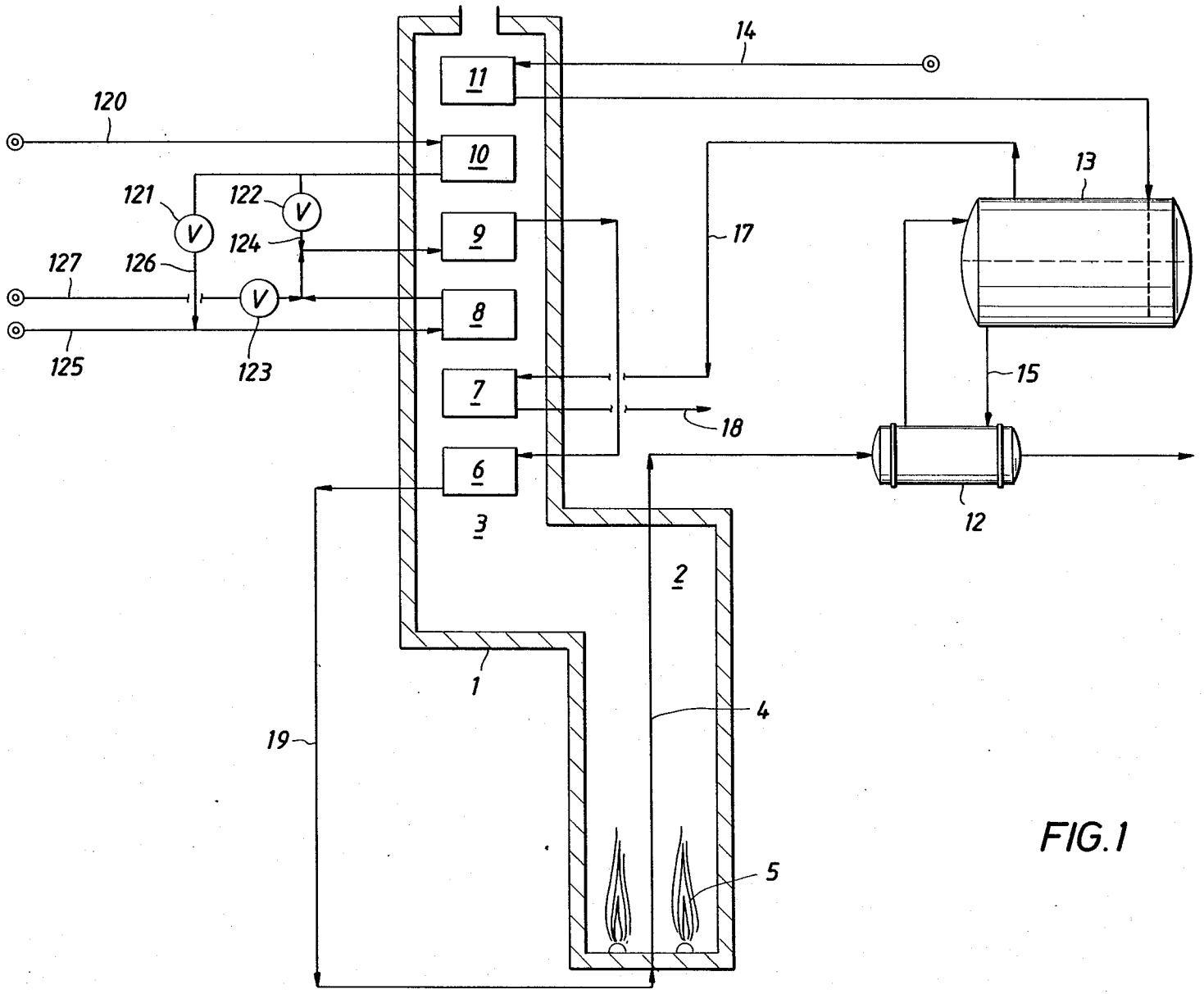
FIG. 1 illustrates an embodiment of the invention wherein the mixed feed is cooled by injection of boiler feedwater which is subsequently vaporized to process diluent steam.
Figure 2:
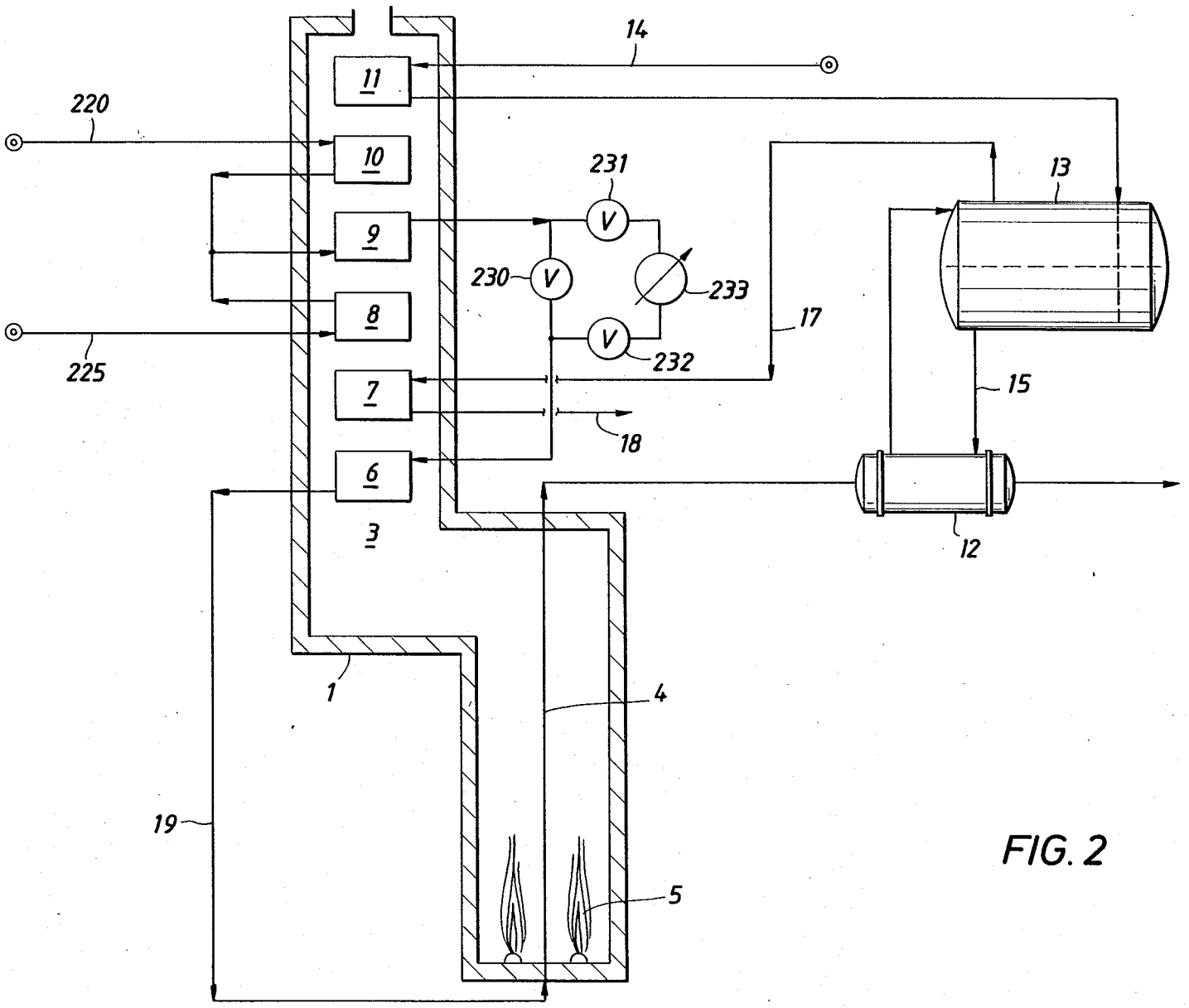
FIG. 2 illustrates another embodiment of the invention wherein the mixed feed is cooled by indirect heat exchange in an exchanger that is external to the convection section of the furnace.
Figure 3:
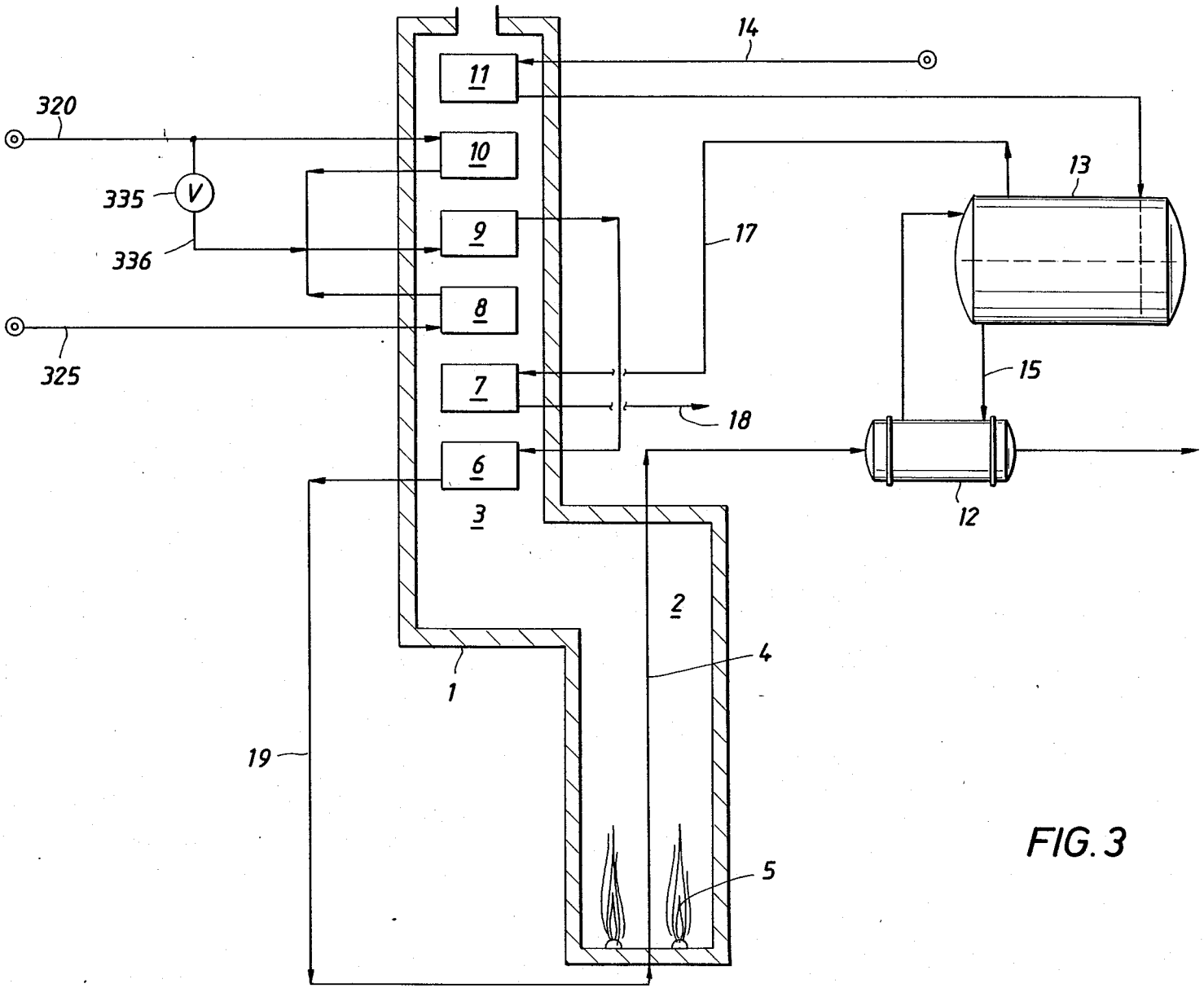
FIG. 3 illustrates yet another embodiment of the invention wherein the mixed feed is cooled by injection of a relatively cool hydrocarbon stream which may be a portion of the initial hydrocarbon feed as illustrated.

Referring to FIGS. 1–3, there is shown a pyrolysis unit designed for steam cracking heavy feeds such as gas oils comprised of a tubular fired furnace 1 having a radiant section 2 and convection section 3. Vertical cracking tubes 4 disposed within the radiant section are heated by floor burners 5. Hot combustion gas from the radiant section passes upwardly through the convection section where heat is successively absorbed from the combustion gas by convection coils 6, 7, 8, 9, 10, and 11. The pyrolysis unit additionally comprises primary quench exchanger 12 for rapidly cooling the cracked gases to stop pyrolysis side reactions and recover heat in the form of high pressure saturated steam collected in steam drum 13. With respect to basic elements of the steam system illustrated in FIGS. 1–3, boiler feedwater introduced through line 14 is preheated in convection coil 11 and passes to drum 13. Feedwater from the drum flows through line 15 to the primary quench exchanger where it is partially vaporized to steam and then returned to the steam drum. Saturated high pressure steam from the drum is passed through line 17 to convection coil 7 where it is superheated and discharged through line 18 to the plant steam system for use in turbine drives employed in the compression and separation of cracked gases.

Referring specifically to FIG. 1, hydrocarbon gas oil boiling between 315° C. and 565° C. is introduced through line 120 and heated in convection coil 10. With this feed, valves 121 and 123 are closed and valve 122 is open for flow of the preheated, initial hydrocarbon feed through line 124 where it joins process diluent steam introduced through line 125 and superheated in convection coil 8 to form a vaporized mixed feed. The mixed feed is heated in convection coils 9 and 6 to a temperature of 545° C., which is slightly below the incipient cracking temperature, and then introduced via line 19 to cracking tubes 4 in the radiant section of the furnace. In the gas oil operation described, the cracking tube outlet temperature is 845° C.

Referring still to FIG. 1, when ethane/propane is selected as the feed, valves 121 and 123 are open and valve 122 is closed. The feed is again introduced through line 120 and preheated in convection coil 10. The preheated, initial hydrocarbon feed flows through line 126 where it joins process diluent steam introduced through line 125 to form mixed feed. In this instance, the process diluent steam introduced is less than half the amount customarily employed in ethane/propane pyrolysis. The mixed feed is heated in coil 8 to 620° C. and then combined with boiler feedwater introduced through line 127 at a temperature of 120° C. which vaporizes and cools the mixed feed by direct heat exchange. The resulting stream at a temperature of 510° C. is then reheated in coils 9 and 6 to a temperature of 650° C., which is slightly below the incipient cracking temperature for this feed, and introduced via line 19 to cracking tubes 4 in the radiant section of the furnace. Needless to say, the vaporized boiler feedwater supplements the process diluent steam introduced through line 125 so that the final steam/hydrocarbon ratio desired is present in the reheated mixed feed. In the ethane/propane operation described, the cracking tube outlet temperature is 880° C.

Individual heat duties for convection coils 6–11 are of the same order of magnitude in both the gas oil and ethane/propane cracking cases which permits efficient utilization of heat in the convection section of the furnace. More importantly, the desired final mixed feed temperature, i.e.—the temperature slightly below the incipient cracking temperature of the feed, is attained in each case.

Referring now to FIG. 2, substantially the same pyrolysis system as in FIG. 1 is shown and reference item numbers 1–19 have substantially the same function. Employing again the gas oil feedstock described in connection with FIG. 1, the feed is introduced through line 220 and preheated in convection coil 10. The preheated, initial hydrocarbon stream is then combined with process diluent steam introduced through line 225 and coil 8 and the resulting vaporized mixed feed is heated in coil 9. In gas oil operation, valve 230 is open while valves 231 and 232 are closed to isolate heat exchanger 233 so that the mixed feed flows directly from coil 9 to coil 6 and then to the cracking tubes.

When ethane/propane is employed as feedstock in the scheme of FIG. 2, valve 230 is closed while valves 231 and 232 are opened to permit cooling the mixed feed from coil 9 in heat exchanger 233 prior to reheating in coil 6. Stream temperatures are, for the most part, comparable to those recited in connection with FIG. 1.

Referring now to FIG. 3, substantially the same pyrolysis system as in FIGS. 1 and 2 is shown and reference item numbers 1–19 have substantially the same function. When gas oil is employed as feedstock in the scheme of FIG. 3, valve 335 is closed and all of the feedstock introduced through line 320 is preheated in coil 10 and combined with process diluent steam introduced through line 325 and coil 8. When ethane/propane is employed as feedstock in the scheme of FIG. 3, valve 335 is open and only a portion of the feed is preheated in coil 10. The preheated, initial hydrocarbon feed is then mixed with diluent steam introduced through line 325 and coil 8 and the resulting mixed feed cooled by hydrocarbon introduced through line 336 which, in this illustration, is the remaining portion of feed from line 320 that has by-passed coil 10. The cooled mixed feed is then reheated in coils 9 and 6.

We claim:

1. A process for steam cracking hydrocarbons in a tubular, fired furnace having a convection section for preheating the hydrocarbons and a radiant section for cracking the preheated hydrocarbons which comprises:

(a) preheating an initial hydrocarbon feed in the convection section;

(b) mixing diluent steam with the resulting preheated, initial hydrocarbon feed to form a mixed feed;

(c) cooling the mixed feed;

(d) reheating the cooled mixed feed in the convection section; and (e) cracking the reheated mixed feed containing all the initial hydrocarbon feed in the radiant section.

2. The process of claim 1 wherein the mixed feed is cooled by direct heat exchange with water.

3. The process of claim 1 wherein the mixed feed is cooled by indirect heat exchange.

4. The process of claim 1 wherein the mixed feed is cooled by direct heat exchange with a hydrocarbon coolant.

5. The process of claim 4 wherein an initial hydrocarbon feed is preheated in the convection section to form the preheated, initial hydrocarbon feed and the hydrocarbon coolant is a portion of the initial hydrocarbon feed.

6. The process of claim 1 wherein the preheated, initial hydrocarbon feed is a normally gaseous hydrocarbon and the mixed feed is cooled by from 55° C. to 220° C.

7. The process of claim 1 wherein the preheated, initial hydrocarbon feed is a normally liquid hydrocarbon having an initial boiling point between 25° C. and 120° C. and an end point between 150° C. and 230° C. and the mixed feed is cooled by from 55° C. to 140° C.

8. The process of claim 6 wherein the cooled mixed feed is reheated to from 565° C. to 705° C.

9. The process of claim 7 wherein the cooled mixed feed is reheated to from 540° C. to 650° C.

* * * * *